US005909178A

United States Patent [19]

Balch et al.

[11] Patent Number: 5,909,178

[45] Date of Patent: Jun. 1, 1999

[54] SIGNAL DETECTION IN HIGH NOISE ENVIRONMENTS

[75] Inventors: Brent F. Balch, Fort Lauderdale; John A. Allen, Pompano Beach, both of Fla.

[73] Assignee: Sensormatic Electronics Corporation, Boca Raton, Fla.

[21] Appl. No.: 08/980,484

[22] Filed: Nov. 28, 1997

[51] Int. Cl.[6] ..... G08B 13/14

[52] U.S. Cl. ..... 340/572.4; 340/551

[58] Field of Search ..... 340/572.4, 572.1, 340/551, 552

[56] References Cited

U.S. PATENT DOCUMENTS

| | | | |
|---|---|---|---|
| 3,828,337 | 8/1974 | Lichtblau | 340/572 |
| 4,527,152 | 7/1985 | Scarr et al. | 340/572 |
| 4,644,286 | 2/1987 | Torre | 329/50 |
| 4,658,241 | 4/1987 | Torre | 340/551 |
| 4,675,658 | 6/1987 | Anderson et al. | 340/551 |
| 4,963,880 | 10/1990 | Torre et al. | 343/866 |
| 5,023,600 | 6/1991 | Szklany et al. | 340/572 |
| 5,049,857 | 9/1991 | Plonsky et al. | 340/551 |
| 5,353,011 | 10/1994 | Wheeler et al. | 340/572 |
| 5,495,229 | 2/1996 | Balch et al. | 340/551 |
| 5,602,531 | 2/1997 | Rude et al. | 340/572 |
| 5,627,516 | 5/1997 | Balch et al. | 340/572 |
| 5,640,693 | 6/1997 | Balch et al. | 455/127 |
| 5,673,024 | 9/1997 | Frederick et al. | 340/572 |
| 5,748,086 | 5/1998 | Bettine et al. | 340/572 |

*Primary Examiner*—Nina Tong
*Attorney, Agent, or Firm*—Quarles & Brady LLP

[57] ABSTRACT

A method for adjusting a validation threshold for detecting a marker in an interrogation zone of an electronic surveillance system, comprising the steps of: (a.) tracking individual moving averages of background noise in a plurality of operational phase windows; (b.) tracking a moving variance for each of the moving averages of the background noise in each of the plurality of windows; and, (c.) continuously adjusting a validation threshold for detecting the marker in the interrogation zone responsive to the moving averages and responsive to the moving variances.

17 Claims, 3 Drawing Sheets

SIGNAL DETECTION IN HIGH NOISE ENVIRONMENTS

BACKGROUND OF THE INVENTION

1. Field of the Invention

This invention relates to the field of electronic article surveillance (EAS) systems, and in particular, to enhancing detection sensitivity and reliability of EAS systems operating in high noise environments.

2. Description of Related Art

In an EAS system markers or tags affixed to articles are expected to pass through an interrogation zone defined by a magnetic field generated by the EAS system. The markers or tags have a characteristic signal response which can be detected by the EAS system. There are contradictory goals in implementing EAS systems. One goal is to maximize the likelihood of detecting a marker or tag. Achieving this goal requires maximum sensitivity to the received signal. Another goal is to eliminate false detection, so as to avoid unnecessary embarrassment of a customer who is not really stealing an article. Achieving this goal requires maximum immunity to electrical background noise received from the interrogation zone, by itself or in conjunction with a valid marker response. Improving sensitivity tends to reduce noise immunity and improving noise immunity tends to reduce sensitivity.

Electrical noise is herein considered to be any undesired signal, with regard to amplitude or frequency, or both, present at the detector of an EAS receiver. Electrical noise comes from two primary sources, namely from sources internal to the EAS system and from sources external of the EAS system. Internal sources include system generated signals and circuit noise. External sources can be divided into environmental sources, such as lightning, and man-made sources, such as noise on local electrical wiring and nearby electrical devices. Noise from any source competes with desired signals and thus reduces system sensitivity.

Internal, system-generated signals can often be gated or filtered, or reduced by physical isolation, for example by shielding. Circuit noise, including thermal and junction noise can often be reduced through careful layout techniques and component selection.

External sources represent the largest source of noise faced by an EAS receiver. Environmental noise is broad-spectrum, and so contains energy within the receiver's bandwidth. However, environmental noise is also intermittent, and so can usually be treated through some form of time dependent processing. Man-made sources are the most pernicious form of interference. Electrical devices are often located close to an EAS system and therefor have high signal levels. Many such sources produce signals having an energy spectrum falling at or near the system's band of interest, and often the sources are active continuously, resulting in a constant loss in sensitivity.

Due to the bandpass filters typically used on EAS receivers, broad-spectrum noise appearing at the input to an EAS receiver, including equivalent input circuit noise, appears as normally distributed or Gaussian noise at the receiver's detector. While this Gaussian noise is random in nature, it can be processed statistically with some success. In order to provide maximum sensitivity consistent with minimum false alarms, EAS receivers typically operate with a 10–12 dB signal-plus-noise to noise ratio, conveniently designated (S+N)/N. A tag or marker signal must therefore be 3 to 4 times greater than the average background noise level to be considered significant. In low noise environments, this does not pose a problem. However, when nearby man-made sources, such as television and computer monitors, motor speed controllers, lamp dimmers, neon signs, and the like, produce a high noise environment, these high level signals result in a correspondingly high noise average, raising the detection threshold proportionately and seriously reducing sensitivity. These man-made sources are non-Gaussian in nature, having high energy levels at particular frequencies or bands of frequencies. Unfortunately, previous receiver designs have been unable to characterize and adjust for the differences between random Gaussian noise and coherent man-made sources.

The operation of a pulsed magnetic EAS system available from Sensormatic Corporation synchronizes its operation by sensing local power line zero crossings. Each line cycle is divided up into six time windows: three windows for transmission and three windows for reception. The first transmit-receive window sequential pair, designated Phase A herein, occurs at 0° with respect to the zero crossing. The second transmit-receive window sequential pair, designated Phase B herein, occurs at 120° with respect to the zero crossing. The third transmit-receive window sequential pair, designated Phase C herein, occurs at 240° with respect to the zero crossing.

Previous implementations of this pulsed magnetic EAS system receiver computes a detection threshold based on a fixed signal-to-noise ratio (SNR), or more accurately, a signal-plus-noise-to-noise ratio as explained above. The receivers keep track of the background noise and continuously compute a running arithmetic average. The detection threshold is set to a defined number of dB above this average. The default is typically 12 dB, or four times (4×) the average. When a tag or marker enters the interrogation field of the system, the signal level of the tag must exceed this detection threshold, also referred to as a validation threshold, in order for processing to continue. The (S+N)/R is programmable at the time of system installation, but once set, the system uses this fixed ratio to track changes in background noise. A margin of 12 dB has been found to provide the best compromise between maximum sensitivity and false alarm immunity. Assuming Gaussian noise at the detector, the chance of the system falsely initiating a validation sequence due to noise is less than 0.2%.

The best EAS system performance is achieved when its receiver is operating at its maximum sensitivity consistent with the dynamics of the noise environment. Any factors which keep the receiver from achieving this maximum sensitivity degrade system performance.

Known pulsed magnetic EAS systems track background noise by computing a simple arithmetic moving average, in a manner according to Equation 1 below, of the instantaneous noise values sampled during receiver time windows wherein the receiver was not anticipating signals from a magnetic tag or marker, i.e. windows not preceded by a transmitter burst. The assumption is that, noise events being random, signal levels due to noise should be equal whether they are sampled during a receiver noise window or during a "tag window", that is, when a magnetic tag or marker would produce a response. Whenever the signal levels detected during a tag window exceed those during a corresponding noise window by a predetermined margin, the assumption is that the tag window response is due to a tag or magnetic marker within the system's interrogation field, and a validation sequence is initiated to determine if the characteristics of the tag window response is consistent with a valid marker. These characteristics include, for example, whether the signal is of sufficient amplitude and duration, whether the signal has the correct frequency characteristic and whether the signal tracks or follows the transmitter burst. Any time the system erroneously initiates a validation sequence, there is an increased chance of initiating a false alarm.

For sample size n, the arithmetic average is calculated as follows:

$$\text{Arithmetic Average} = \frac{(\text{sample}_n + \text{sample}_{n-1} + K + \text{sample}_1)}{n} \quad (1)$$

The problem with relying on a simple arithmetic average is that the system reacts twice for each change in the noise environment. The first reaction occurs when the sample enters the group being averaged. The second reaction occurs when the sample leaves the group being averaged. As long as a sample remains part of the group of samples in a moving average, the sample exerts the same influence or weighting factor on the average. When the sample drops out of the sample group, the average undergoes a second transient event which does not correspond to any real change in the noise environment. This can lead to initiation of undesired validation sequences.

Assume, for example, a receiver is operating in an environment with no magnetic markers in the system's interrogation field, and further assume a relatively constant background noise level. The system will compute a moving average of the background noise and determine a validation threshold at some defined number of dB above this average. Now assume a particular noise window wherein the instantaneous noise components with their respective phase characteristics combine so as to cancel each other. The resultant noise reading for that window could be significantly lower than previous windows. This lower than normal sample is added to the sample group to compute the moving average and it substantially lowers the average. Now the typical values, due to background noise, in the tag window can exceed the validation threshold and the system erroneously enters a validation sequence. Depending on the size of the sample group which makes up the moving average, the validation threshold could be exceeded for some time, perhaps long enough to complete a validation sequence and initiate a false alarm.

SUMMARY OF THE INVENTION

A method for adjusting a validation threshold for detecting a marker in an interrogation zone of an electronic surveillance system, in accordance with an inventive arrangement comprises the steps of: (a.) tracking individual moving averages of background noise in a plurality of operational phase windows; (b.) tracking a moving variance for each of the moving averages of the background noise in each of the plurality of windows; and, (c.) continuously adjusting a validation threshold for detecting the marker in the interrogation zone responsive to the moving averages and responsive to the moving variances.

The method can further comprise the steps of: continuously calculating a weighted moving average based on the moving averages in the step (a.); and, tracking the moving variance in the step (b.) for each of the weighted moving averages. Alternatively, the method can further comprise the steps of: continuously calculating an exponential moving average based on the moving averages in the step (a.); and, tracking the moving variance in the step (b.) for each of the exponential moving averages.

As set forth originally, or in accordance with either of the preceding alternatives, the method can further comprise the steps of: calculating a standard deviation of the moving variances; and, continuously adjusting the validation threshold for detecting the marker in the interrogation zone in the step (c.) responsive to the moving averages and responsive to the standard deviation.

The method can further comprise the step of adjusting the size of the weighted moving average, or the exponential average, by a programmable factor to control a response time of the method.

In all cases, the method can further comprise the steps of: comparing the validation threshold to a programmed minimum signal-to-noise ratio; and, preventing the validation threshold from falling below the programmed minimum signal-to-noise ratio.

A method for adjusting a validation threshold for detecting a marker with a receiver in an interrogation zone of an electronic surveillance system, in accordance with another inventive arrangement, comprises the steps of: (a.) tracking at least one statistical characteristic of a signal received by the receiver in a plurality of operational phase windows; (b.) tracking a statistical variance for the at least one statistical characteristic of the signal received by the receiver in each of the plurality of windows; and, (c.) continuously adjusting a validation threshold for detecting the marker in the interrogation zone responsive to the statistical variance.

The method can further comprise the step of also continuously adjusting the validation threshold responsive to the at least one statistical characteristic.

In either case, the method can comprise the step of tracking background noise as the signal received by the receiver.

As in the first inventive arrangement, the method can further comprise the steps of: comparing the validation threshold to a programmed minimum signal-to-noise ratio; and, preventing the validation threshold from falling below the programmed minimum signal-to-noise ratio.

DETAILED DESCRIPTION OF THE PREFERRED EMBODIMENTS

Changing an EAS system's method for evaluating received signals to instead use either an exponential or weighted average as shown in Equation 2 improves the process:

$$\textit{Exponential Average} = (\textit{current sample} \times k1) + [\textit{Prev.Exp.Avg.} \times (1-k1)] \quad (2)$$

where k is a weighting coefficient controlling the response time of the average.

When a sample enters the group of samples in a moving average it expectedly contributes its influence on the overall average. However, as successive samples are added and old samples dropped from the group, the weight of the sample in question decreases as it recedes in time from more current samples. Even if a chance occurrence of noise signals results in falsely entering a validation sequence as above, the average quickly returns to normal and the validation sequence is immediately terminated.

A second, and more important improvement in the detection algorithm can be attained by improving the manner in which the system determines its validation threshold. If the assumption is made that background noise is random, and that the noise signals at the output of the detector are Gaussian, due to the shaping of preceding bandpass filters, then statistical inferences can be made about the character of the noise. If the validation threshold is set to a level 12 dB, corresponding to 3.98×above the noise average, then as noted above, the chance of the system falsely initiating a validation sequence due to noise is less than 0.2%. This provides sufficient protection from false validation sequences initiated by noise and is illustrated in FIG. 1.

Figure 1:
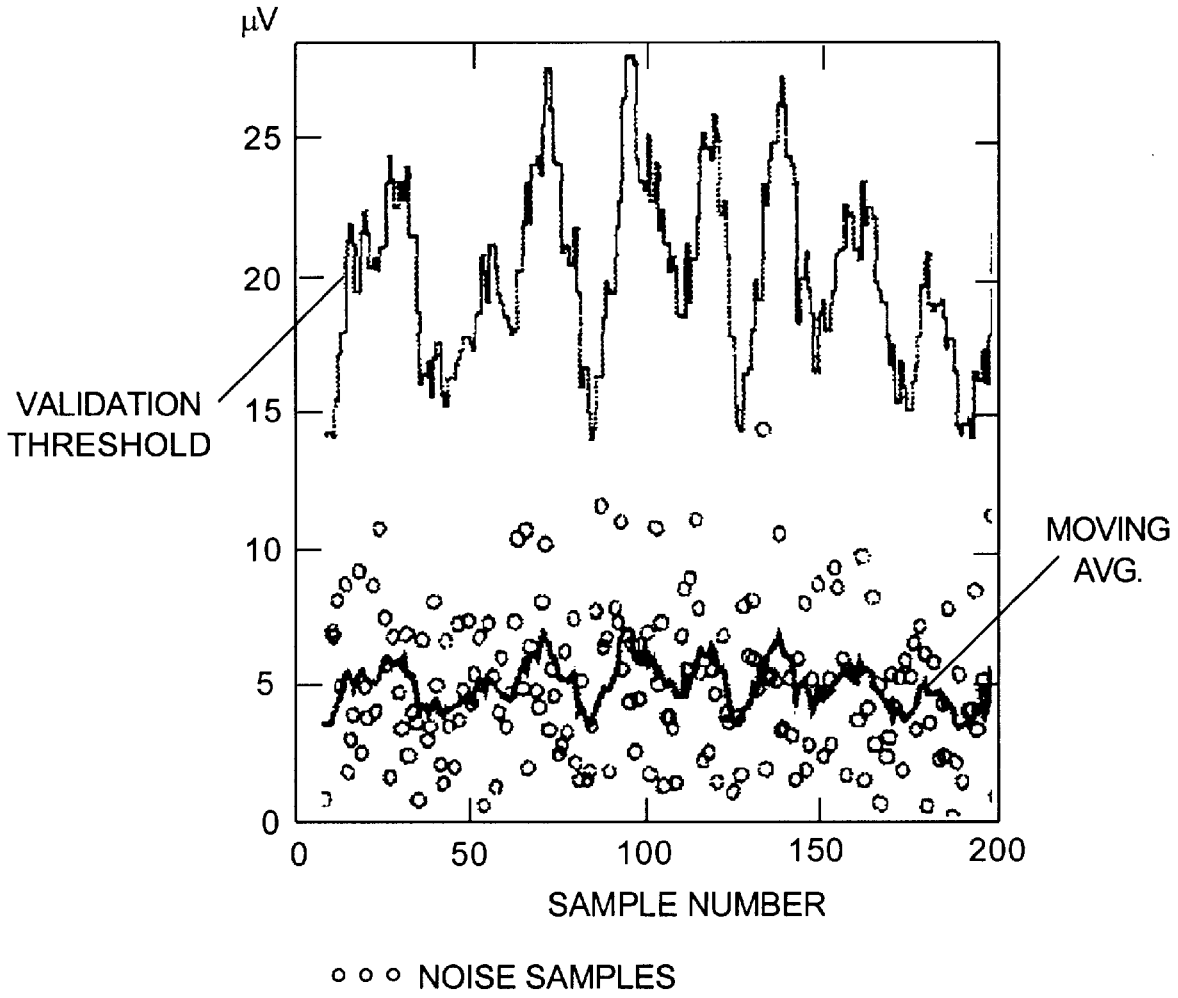
FIG. 1 is a plot useful for explaining the validation threshold tracking based on the moving average of the output of the receiver's detector circuit.

FIG. 1 is a plot illustrating how the validation threshold tracks the moving average of the output of the receiver's detector circuit. The levels correspond to an equivalent input noise of 5 $\mu$V. As long as detector output levels do not exceed the validation threshold, the system will not initiate a validation sequence and there is no chance of an erroneous alarm signal.

In the existing system, the validation threshold is determined by:

$$\text{Validation Threshold} = \text{moving average} \times 10^{\left(\frac{SNR}{20}\right)} \tag{3}$$

where SNR is the defined signal-to-noise ratio in dB. However, if a coherent, non-Gaussian noise source affects the system, the validation threshold would similarly be raised to 12 dB above the noise average, even though the random and unpredictable behavior of the background noise has not increased. The system has lost up to 12 dB of sensitivity without a justifying risk of false alarms, as shown in FIG. 2.

Figure 2:
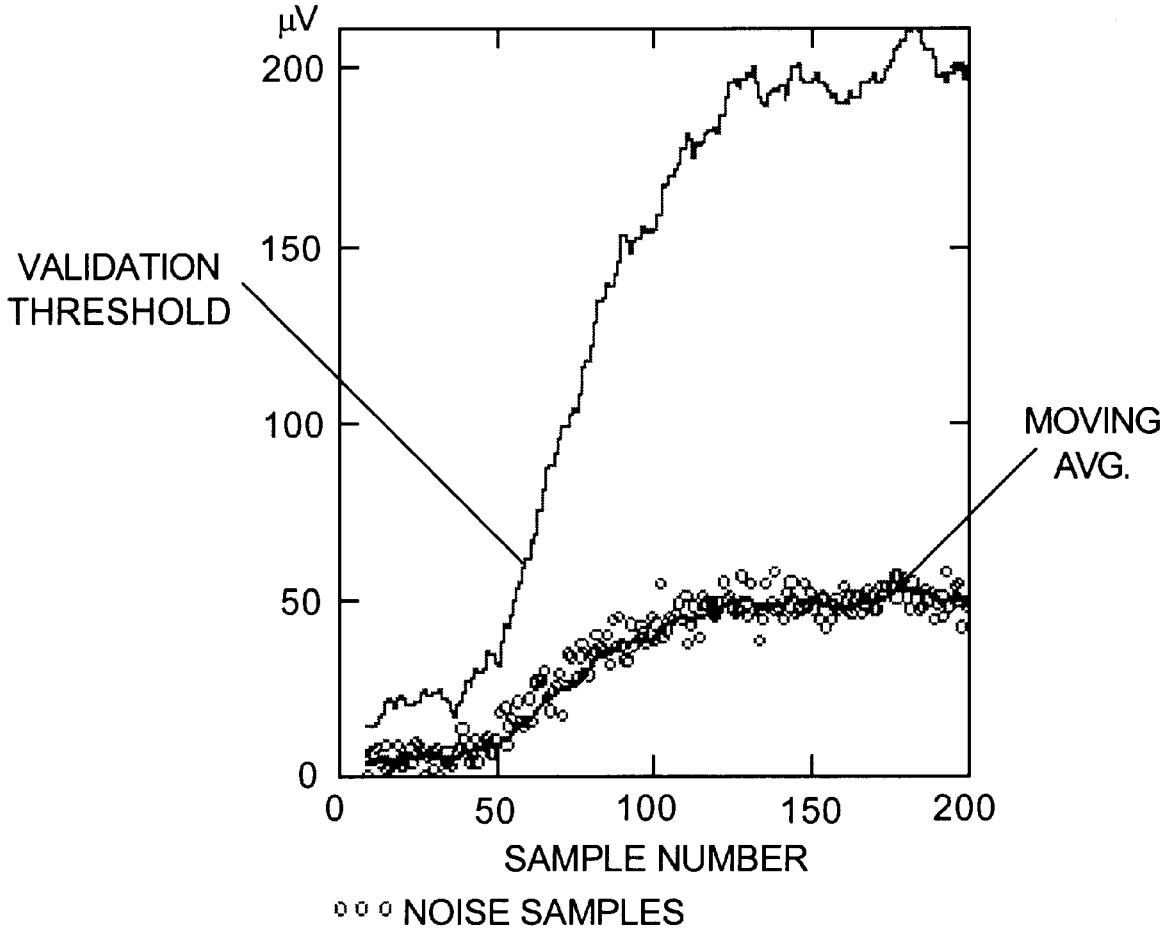
FIG. 2 is a plot useful for explaining the effect on system sensitivity resulting from the introduction of 50 $\mu$V of non-Gaussian noise at the receiver input.

FIG. 2 shows the effect on system sensitivity with the introduction of 50 $\mu$V of non-Gaussian noise at the receiver input. FIG. 2 shows exactly the same 5 $\mu$V Gaussian noise data seen as FIG. 1. It should be noted that the validation threshold, and hence minimum system sensitivity, has moved up to approximately 200 $\mu$V. The system is in effect over protected, since the validation threshold would only have had to rise to about 65 $\mu$V to provide the same insurance against false alarms.

If the system, in addition to keeping track of individual moving averages of the background noise in each of the operational phase windows A, B and C, and in accordance with the inventive arrangements, also tracks a moving variance, or a standard deviation, for each corresponding window, then a modified detection method incorporating factors to account for the degree of randomness of the background noise in each receiver phase can restore much of the sensitivity currently given up when coherent noise sources are present, as is the case described in connection with FIG. 2. The validation threshold can advantageously be continuously adjusted responsive to the moving variances, and not just responsive to the moving average of the noise. The validation threshold is thereby also based on the character of the noise itself, which can also be thought of as representing a type of noise threat assessment.

A generalized equation for calculating an improved threshold in accordance with this inventive arrangement is:

$$\text{Improv Valid Thresh} = \text{MovAvg} \times \left[10^{\left(\frac{SNR}{20}\right)} - k2 \times (\text{NormAvg} - \text{NormVar})\right] \tag{4}$$

where NormAvg and NormVar and normalized forms of the moving average and moving variances, respectively. These normalized forms each range between 0 and 1. K2 is a coefficient which determines the degree of control the variance factor has on the ultimate threshold. When NormAvg and NormVar are nearly equal, as when the background noise is more nearly Gaussian, that segment of the equation approaches 0, Equation (4) reduces to Equation (3) and the validation threshold rises toward the SNR in dB above the noise average.

As the background noise becomes more coherent and less Gaussian, the normalized or relative variance increases compared to the normalized noise average, this segment approaches unity, and the bracketed section approaches a ratio which can be thought of as a minimum SNR. This minimum SNR represents a safety margin, below which the threshold should not go.

A more practical implementation of this approach is represented by Equation (5):

$$\text{Val. Threshold} = \text{Exp. Mov. Avg} \times \left[r1 - k2 \times \left(1 - k3 \times \left(\frac{\text{Exp. Std. Deviation}}{\text{Exp. Mov. Avg}}\right)\right)\right] \tag{5}$$

where r1 is the defined SNR expressed as a ratio, k2 is a coefficient determining the minimum SNR as explained above, and k3 is further coefficient which controls the aggressiveness or attack rate of the correction term.

Figure 3:
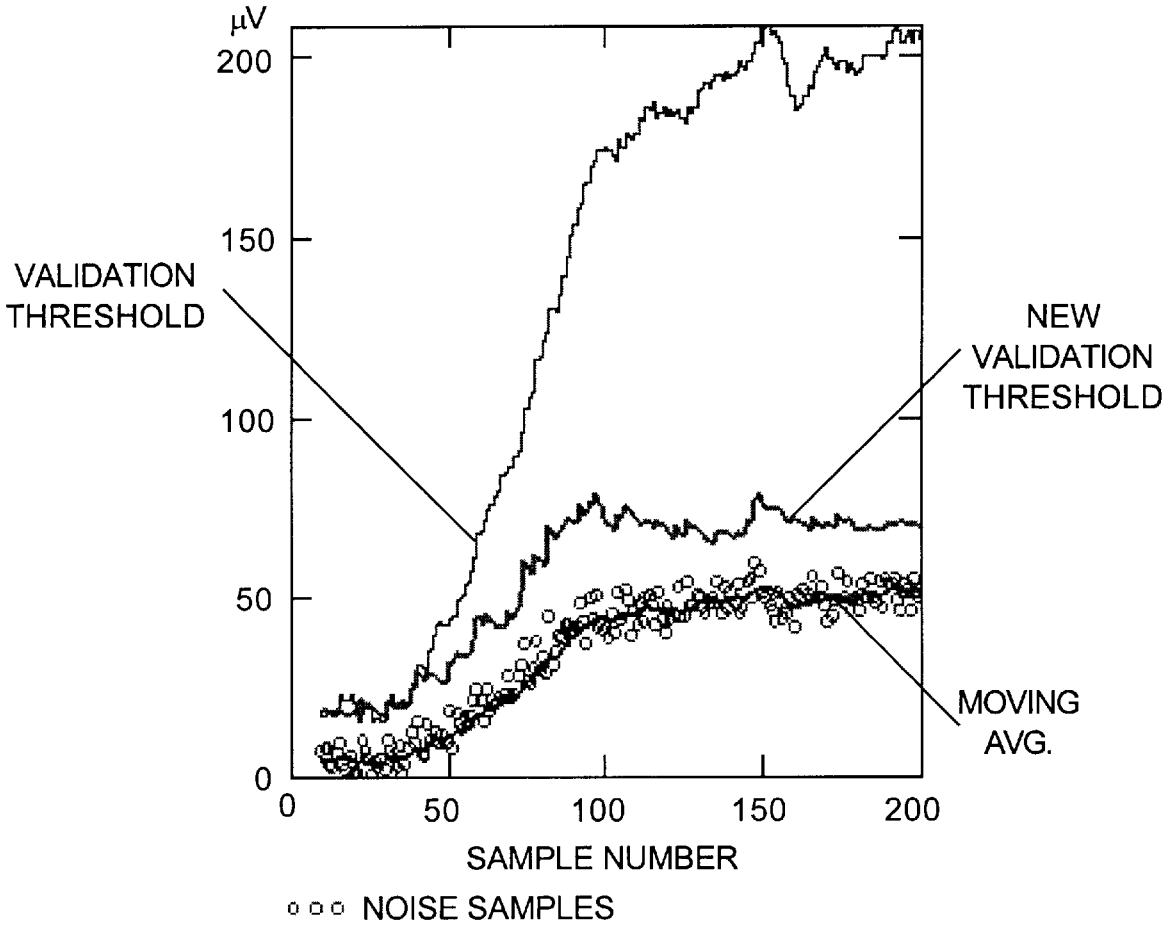
FIG. 3 is a plot useful for explaining adjustment of the validation threshold in accordance with the inventive arrangements during conditions of increasing non-Gaussian background noise.

Since the variance is proportional to the square of the sample deviations from the moving average, the standard deviation, which is the square root of the variance, provides a more satisfactory relationship. FIG. 3 shows the degree of improvement possible using this new method. FIG. 3 also shows the current validation threshold rising to a very high level due to the increase in non-Gaussian background noise, as in FIG. 2. The line denoted new validation threshold indicates the reduction in the validation threshold possible as the noise increases. The amount of improvement actually increases as the noise becomes increasingly non-Gaussian. While some sensitivity has been lost because marker signals do have to compete with this real increase in background noise, sensitivity improvements of from 2 to 11 dB can be achieved using the new method.

With the proliferation of electronic devices of all kinds within the retail environment, electrical noise has become an increasingly serious problem affecting reliable operation of EAS systems. Enhancements which improve the ability of EAS systems to reliably operate in high noise environments, in accordance with the inventive arrangements, will provide a significant competitive advantage in the marketplace.

What is claimed is:

1. A method for adjusting a validation threshold for detecting a marker in an interrogation zone of an electronic surveillance system, comprising the steps of:

(a.) tracking individual moving averages of background noise in a plurality of operational phase windows;

(b.) tracking a moving variance for each of said moving averages of said background noise in each of said plurality of windows; and, (c.) continuously adjusting a validation threshold for detecting said marker in said interrogation zone responsive to said moving averages and responsive to said moving variances.

2. The method of claim 1, further comprising the steps of:

continuously calculating a weighted moving average based on said moving averages in said step (a.); and, tracking said moving variance in said step (b.) for each of said weighted moving averages.

3. The method of claim 2, further comprising the steps of:

calculating a standard deviation of said moving variances; and, continuously adjusting said validation threshold for detecting said marker in said interrogation zone in said step (c.) responsive to said moving averages and responsive to said standard deviation.

4. The method of claim 2, further comprising the step of adjusting the size of said weighted moving average by a programmable factor to control a response time of said method.

5. The method of claim 2, further comprising the steps of:

comparing said validation threshold to a programmed minimum signal-to-noise ratio; and, preventing said validation threshold from falling below said programmed minimum signal-to-noise ratio.

6. The method of claim 1, further comprising the steps of:

continuously calculating an exponential moving average based on said moving averages in said step (a.); and, tracking said moving variance in said step (b.) for each of said exponential moving averages.

7. The method of claim 6, further comprising the steps of:

calculating a standard deviation of said moving variances; and, continuously adjusting said validation threshold for detecting said marker in said interrogation zone in said step (c.) responsive to said moving averages and responsive to said standard deviation.

8. The method of claim 6, further comprising the step of adjusting the size of said exponential moving average by a programmable factor to control a response time of said method.

9. The method of claim 6, further comprising the steps of:

comparing said validation threshold to a programmed minimum signal-to-noise ratio; and, preventing said validation threshold from falling below said programmed minimum signal-to-noise ratio.

10. The method of claim 1, further comprising the steps of:

calculating a standard deviation of said moving variances; and, continuously adjusting said validation threshold for detecting said marker in said interrogation zone in said step (c.) responsive to said moving averages and responsive to said standard deviation.

11. The method of claim 10, further comprising the steps of:

comparing said validation threshold to a programmed minimum signal-to-noise ratio; and, preventing said validation threshold from falling below said programmed minimum signal-to-noise ratio.

12. The method of claim 1, further comprising the steps of:

comparing said validation threshold to a programmed minimum signal-to-noise ratio; and, preventing said validation threshold from falling below said programmed minimum signal-to-noise ratio.

13. A method for adjusting a validation threshold for detecting a marker with a receiver in an interrogation zone of an electronic surveillance system, comprising the steps of:

(a.) tracking at least one statistical characteristic of a signal received by said receiver in a plurality of operational phase windows;

(b.) tracking a statistical variance for said at least one statistical characteristic of said signal received by said receiver in each of said plurality of windows; and, (c.) continuously adjusting a validation threshold for detecting said marker in said interrogation zone responsive to said statistical variance.

14. The method of claim 13, further comprising the step of also continuously adjusting said validation threshold responsive to said at least one statistical characteristic.

15. The method of claim 14, further comprising the steps of:

comparing said validation threshold to a programmed minimum signal-to-noise ratio; and, preventing said validation threshold from falling below said programmed minimum signal-to-noise ratio.

16. The method of claim 13, comprising the step of tracking background noise as said signal received by said receiver.

17. The method of claim 13, further comprising the steps of:

comparing said validation threshold to a programmed minimum signal-to-noise ratio; and, preventing said validation threshold from falling below said programmed minimum signal-to-noise ratio.

* * * * *